United States Patent [19]

Singleton

[11] 3,939,054

[45] Feb. 17, 1976

[54] NONSYMMETRICAL HEXAGONAL ELECTROPLATING BARREL

[76] Inventor: Albert Singleton, 7360 Brookside Park, Middleburg Heights, Ohio 44130

[22] Filed: Dec. 13, 1974

[21] Appl. No.: 532,725

[52] U.S. Cl. ..... 204/213; 118/418; 134/159; 259/89

[51] Int. Cl.[2] ..... C25D 17/20

[58] Field of Search ..... 204/213, 214; 259/89, 90; 134/159; 118/418

[56] References Cited

UNITED STATES PATENTS 3,767,554 10/1973 Noonan ..... 204/213

*Primary Examiner*—G. L. Kaplan
*Assistant Examiner*—W. I. Solomon
*Attorney, Agent, or Firm*—Fay & Sharpe

[57] ABSTRACT

A nonsymmetrical electroplating barrel having two end pieces and six sides, one side being a door opening suitable for loading and unloading the barrel. The door opening having a width greater than each of the other five sides. The two sides closest to the door opening being of the same width but being of a smaller width than the door and the other three sides. The three sides farthest from the door being of uniform width. The purpose of the dimensional limitations is to increase the inside volume of the electroplating barrel while using a conventional pair of end pieces thereby allowing the larger volume barrel to be substituted in conventional sizes of electroplating tanks.

13 Claims, 7 Drawing Figures

NEW DIMENSIONS (inches)

| NOMINAL DIA. | A | B | C | D | E |
|---|---|---|---|---|---|
| 12" | 17.0000 | 7.0625 | 8.3720 | 7.1440 | 10.1250 |
| 14" | 19.8750 | 8.0625 | 9.4530 | 8.3720 | 11.2500 |
| 16" | 22.0000 | 9.0625 | 10.6080 | 9.4530 | 12.3750 |
| 18" | 23.7500 | 10.0625 | 11.7630 | 10.6080 | 13.5000 |
| 20" | 26.0000 | 11.0625 | 12.9180 | 11.7630 | 14.6250 |

OLD DIMENSIONS (inches)

| NOMINAL DIA. | A | B | C | D | E |
|---|---|---|---|---|---|
| 12" | 17.0000 | 6.0625 | 7.1440 | 6.5000 | 8.2500 |
| 14" | 19.8750 | 7.0625 | 8.3720 | 8.3720 | 9.0000 |
| 16" | 22.0000 | 8.0625 | 9.4530 | 9.4530 | 10.1250 |
| 18" | 23.7500 | 9.0625 | 10.6080 | 10.6080 | 11.2500 |
| 20" | 26.0000 | 10.0625 | 11.7630 | 11.7630 | 12.3750 |
| 22" | 28.5000 | 11.0625 | 12.9180 | 12.9180 | 13.5000 |

NONSYMMETRICAL HEXAGONAL ELECTROPLATING BARREL

BACKGROUND OF THE INVENTION

Over the years the sizes of barrels for electroplating apparatus have been standardized such that the barrels are interchangeable as between manufacturers. Similarly all such barrels are designed to be symmetrical about the axis of rotation. It is common in the trade to refer to a "16 inch barrel" and those in the trade will know that the individual has referred to a barrel of plastic construction which is symmetrical having six sides with one removable side used as a door for filling and emptying the barrel and where the dimension diagonally across between parallel sides is approximately 16 inches; the five side panels (exclusive of the removable door) will be permanently affixed to two end pieces having a generally circular periphery but with perhaps two flat areas, one being parallel with and adjacent to the door opening and the other being parallel with and remote from the door opening.

Where heavy loads are to be tumbled in the barrel it is conventional to have heavily reinforced bars at the corners of the panels because this is thought to be the most likely area of failure. As a general rule both the barrel and the reinforcing bars are of polypropylene or the like. An example of conventional corner reinforcement is noted in that 1969 patent to Kirkpatrick et al., U.S. Pat. No. 3,442,783.

Conventionally, the polypropylene end pieces of the barrel are grooved and the five permanently affixed side panels are mounted in the grooves, either be welding and/or bolting.

The reason for standardized sizes of electroplating barrels is that electroplating tanks must be standardized to receive such barrels and to receive standardized anode baskets which hold the copper, zinc, etc., balls or pieces which comprise the metal which is being plated on the contents of the electroplating barrel. Obviously, it would be desirable to increase the volume of the barrel without increasing its radius of rotation because that would increase the amount of material that could be plated in a unit of time in a conventional electroplating tank.

During the course of research on ways to increase the volume of the electroplating barrel without resorting to anything other than conventional standardized sizes of apparatus currently available, the inventor herein discovered the dimensional relationships to be explained subsequently.

BRIEF DESCRIPTION OF THE INVENTION

It was observed over several years of repair work that on barrel failures, the failure occurred most often on the side panels about the middle of the panel, seldom at the edges where the panels are joined. In use over a long period of time, the center portions of the panel begin to buckle and eventually they define a wavy pattern. It seems clear that industry's concern for corner failure is misplaced. It is speculated (with some confidence) that the reason for this is the differential heating that goes on during the electroplating process. The center part of the panel heats first and as a consequence it expands and it is also more pliable. Thus, the pounding by the heavy metal parts during the tumbling operation tends to stretch the hotter center portion of the panel more than its cooler reinforced edges.

As a consequence of this observed phenomenon the inventor herein decided to experiment with a barrel having no reinforcing at the corners. That is, the observation that corner failure occurs much less frequently than other kinds of failure gave rise to the thought that the heavy corner reinforcement might be unnecessary and that other reinforcement might be appropriate where the greatest problems occur. The applicant's prior patents have included some unique structure in the corner reinforcing area and it includes a rectangular bar of polypropylene having embeded therein a bar of steel designed to prevent bending of the polypropylene bar in one direction. A V-shaped portion is cut from the rectangle such that the V-shaped surfaces will be flush with the converging surfaces of the side panels.

The resulting experimental barrels were constructed without the reinforcing polypropylene bar and enclosed metal bar and the corners were welded together in a conventional manner. In subsequent testing it was observed that there was no greater incidence of corner failure but there was slightly less center buckling in the panels than with a comparable barrel used during the same period having reinforced corners. The center parts of the panels heat more quickly than the corners of the barrels because of the more ready circulation of hot fluids to that area and the smaller mass of the panels in that area; thus, without the corner reinforcement the expansion, contraction and resultant stretching are more uniform.

Conventional side panels have numerous holes drilled completely through the panels to provide easy circulation of the electroplating fluid during the tumbling operation. The edges of the panels, where they are joined together, do not have drilled holes and as a consequence they will heat and cool more slowly than the parts of the panel having the perforations.

To further minimize the differential heating and further reinforce the barrel at its weakest point it was decided to place reinforcing bars longitudinally down the center of the panels. To emphasize the significance, two things are accomplished, (1) the panel is strengthened at its weakest point (although a certain amount of fluid flow is curtailed) and (2) a more uniform mass is provided, thereby serving as a heat sink on each panel to help equalize the heating and cooling sequence. It was found that this was very helpful in preventing buckling and in increasing the life of the individual panels.

With this by way of background it was next observed that without the heavy reinforcing bars at the corners, the end pieces of the plating barrel could accommodate a larger sized panel without any part of the barrel extending beyond the circular periphery of the end pieces. During experimentation without the one inch reinforcing bars it was noted that the lower three side panels of any barrel could be lowered one inch without the panels being displaced beyond the periphery of the end pieces. In other words, with the corner reinforcing bars removed, a conventional end piece for a 16 inch barrel would accommodate as its three lower panels the panel sizes for an 18 inch barrel (the next larger standard size of barrel). The implications are particularly significant when one considers that the lower half of the barrel thus modified is enlarged roughly as the square of the radius of the interior portion of the barrel. For example, the lower half of the barrel increased from the standard 16 inch size to the standard 18 inch size would increase in the lower half of the barrel approximately $$\frac{9^2 - 8^2}{8^2} = \frac{17}{64} = \text{about } 26\%.$$

However, the corresponding 18 inch size door and adjacent side panels could not be used because of the necessity for radially extending blocks or hubs framing the door opening. Obviously the percent increase in volume of the upper half of the barrel is roughly the same as the increase for the lower half although the calculations of volume are a little more complicated.

On further experimentation it was observed that when all angles inside the barrel were maintained at 120°, a nonsymmetrical or assymmetrical hexagonal electroplating barrel could be constructed inside the rotational periphery of the end pieces by (1) using conventional end pieces of one standard size, (2) side panels from the next larger standard size for the three sides most remote from the door, (3) a door of the second larger standard size and (4) side panels adjacent the door of the same standard size as the end pieces.

With all the modifications above enumerated and incorporated into the structure and tested it became clear that over the years, with the many improved plastic welding techniques employed, the corner reinforcing bars had become unnecessary but the industry was unaware of that fact. The experimental barrels incorporating the instant inventive concepts illustrated that the problem of the industry was at the centerline of the side panels and this invention has supplied a solution to the problem while at the same time providing an electroplating barrel of increased capacity.

DESCRIPTION OF THE PREFERRED EMBODIMENTS

Figure 1:
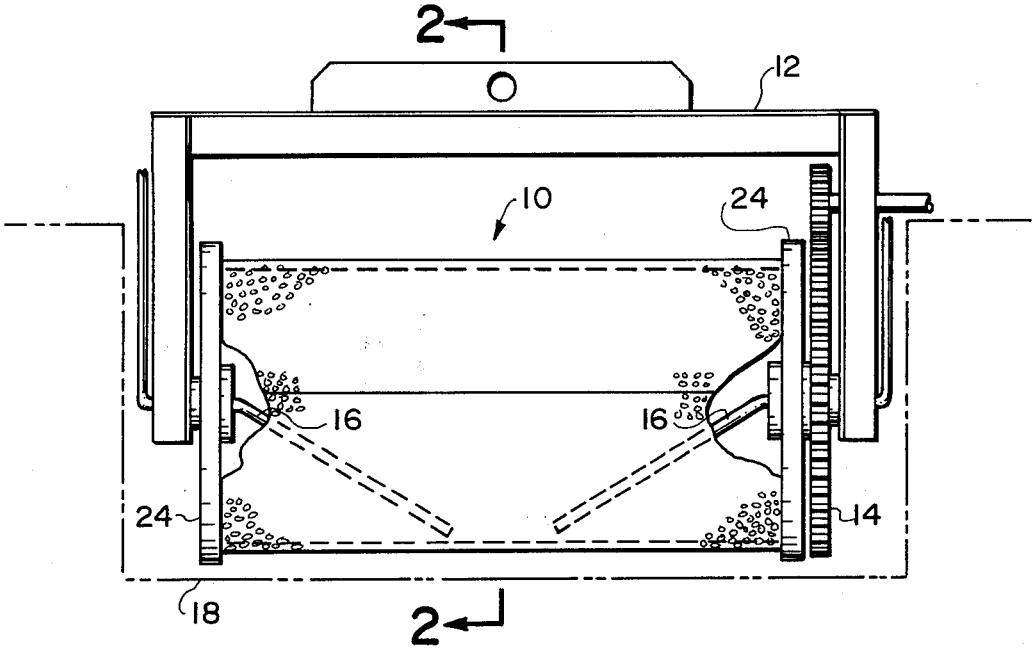
FIG. 1 is an elevational view of a part of an electroplating barrel and its supporting structure.
Figure 2:
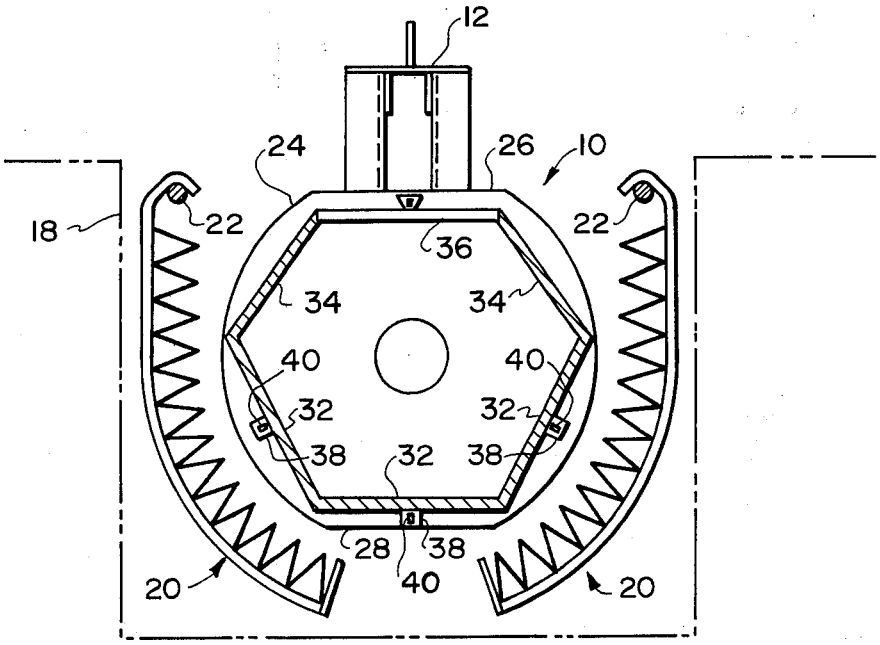
FIG. 2 is a fragmentary sectional view taken along line 2—2 of FIG. 1.

An electroplating barrel 10 is supported on a conventional frame 12 and includes appropriate driving means 14 for rotating the barrel in the conventional manner. Electrodes 16 project through the end hubs of the barrel to provide electrical contact with the barrel interior.

During the normal course of procedure with an electroplating barrel the raising and lowering apparatus will set the barrel into an electroplating tank filled with an appropriate electrolyte, the tank being outlined schematically by broken line 18. The barrel is rotated by the gear 14 to tumble the contents of the barrel in the well-known manner. The metal to be plated on the metallic articles within the tumbling barrel comes from balls or other metallic pieces held in spring wire "anode baskets" 20 which are hooked in conventional manner on anodes 22. Several different ways for attaching the anode basket in electrical contact with the anode are known in the art and any suitable mechanism for hooking the basket on the anode is satisfactory to this invention. What is important is the recognition that particular plating tanks 18 and particular baskets 20 are designed to accommodate specific sizes of barrels. It is conventional in the art to have barrels with a nominal inside barrel diameter of 12, 14, 16, 18, 20, 22, 24, etc., inches. Obviously, if the turning diameter of the barrel is too great the edges of the barrel will contact the anode baskets 20 with resulting damage to the barrel and/or the basket. As a consequence the size limitation placed on an electroplating barrel which may be used in a standard electroplating tank is the periphery of the circle defined by the barrel in rotation. What has been done in the art is to provide end plates of some given dimension and provide that no other part of the barrel will extend beyond the periphery of the end pieces. In this manner no contact would be expected between the rotating barrel and the anode basket.

Apparatus for centering the barrel within the tank are conventional and there appears to be no need to describe this apparatus as any conventional means for centering the barrel on the tank is satisfactory for this invention.

As has been described above, this invention modifies prior structure by taking a standard sized end plate 24 which is generally circular in periphery except for an upper flat 26 and a lower flat 28. The upper flat 26 is designed to be parallel to a door opening 30 in the tank. The bottom flat 28 is diagonally on the opposite side of the end piece 24 and is parallel to flat 26. The inside surface of the end piece 24 has grooves cut therein which form five sides of the resulting barrel. This invention relocates the grooves and modifies their length to provide a nonsymmetrical six sided geometrical shape. The sixth "side" is for the door opening so no groove is cut for that side. The three sides 32 nearest the bottom flat 28 are all substantially the same length and are wider than the two sides 34 adjacent the door opening 30. The door itself has a greater width, that is the distance measured between the free edges of the two side panels 34 at the opening 30 is greater than the width of panels 32 or 34. The reason for the dimensional relationships will be explained subsequently.

It has been conventional over the years to provide reinforcing bars at the welded corners of the plastic plating barrel and this invention has eliminated those bars because they have become unnecessary in view of the improved technology in welding. Reinforcing bars 38 have been added by this invention extending longitudinally of the barrel on each of the panels 32, approximately at the center of the panel extending from one end of the tank to the other, said bars being welded or otherwise bonded to the exterior surface of panels 32. The reinforcing bars 38 include a square or rectangle in cross-section of plastic material, usually polypropylene, which encompasses a steel bar 40 previously disclosed in a number of the applicant's prior patents. The steel bar increases the strength and rigidity of the plastic bar 38 greatly and increases the life of the side panels 32 by balancing two essentially unrelated physical features.

In conventional apparatus the center part of the panels 32 tends to buckle over a period of time and define a wavy appearance after some period of use. This is believed to occur as a result of differential heating of the panel during the electroplating operation. As is well known, the barrel may move in and out of a plurality of plating tanks in a 24 hour period. The center of the panel 32 obviously heats more quickly than the side edges because the apertures through the side panels allow greater hot fluid circulation through the center than at the edges of the panel, where there are no apertures. Thus the corner sections of the barrel which are of greater mass will heat more slowly. In the prior apparatus where the reinforcing bars were at the corners, the differential heating was even more pronounced due to the even larger mass to be heated at the corner. Now, with the modified structure of this invention the reinforcing bar is at the center line of the panel and it provides a more balanced heating. The non-porous corners and bar 38 absorb heat from the adjacent porous portion of the panel and tend to minimize temperature differentials. With the lowered differential heating there is less of a tendency for the panel to buckle, thus increasing its life.

The other physical feature which contributes to the longer life and minimizes the buckling is the reinforcing bar provided at the center line which tends to hold the center line of the panel in a flat plane due to the increased rigidity of the composite panel which includes the side panel 32, plastic bar 38, and metallic bar 40. The stronger panel provides a longer life.

The side panels 34 do not need the reinforcing bar at their center line because they are narrower and the door locking hubs 42 at the edges of the panels adjacent the door opening 30 make them more rigid. The door itself includes a handle 44 of generally triangular shape which includes a reinforcing bar 46 similar in function to the bar 40. The door structure has not been illustrated in detail merely because conventional door structure is well known in the art and conventional structure is used herein except for the dimensional limitations to be outlined subsequently.

Without the 1 inch plastic reinforcing bars at the corners of the conventional electroplating barrel as permitted by the new design described above, the panels themselves can be moved radially 1 inch, still without extending beyond the periphery of the end pieces 24. Observing FIG. 3 it will be seen that the bottom panel 32 can be lowered 1 more inch below the axis of rotation 48 of the barrel. As indicated previously, conventional sized electroplating barrels are calibrated in 2 inch increments. That is, the next conventional size barrel from a nominal 12 inch diameter is a 14 inch diameter (a 2 inch difference in diameter but a 1 inch difference in radius which is significant because the conventional reinforcing bars at the barrel corners are 1 inch thick). Thus, with the dimensional relationships involved, where one previously used a panel size for 12 inch sized barrels one could now use the same end piece but with the next larger size side panels. The only other difference would be the placement and length of the grooves in the end piece. Specifically, where the end piece for a nominal inside diameter of 14 inches was used one could groove the end plate and seat three side panels in place at panel areas designated by number 32 which are of conventional size for 16 inch barrels thereby effectively moving all the panels radially 1 inch.

As can be seen with such a modification the free edges of the three panels for the 16 inch size plating barrel (used as the three bottom panels) exactly rise to the horizontal line 50 bisecting the end plate 24. Line 50 is also the line which defines the upper limit of three conventionally placed 14 inch size side panels, the difference is the panel width and its radial distance from the axis of rotation 48. Thus, by this mechanism an increased internal volume of the electroplating barrel is accomplished in an amount proportional to the difference in the square of the radii of the two standard size barrels.

Figure 3:
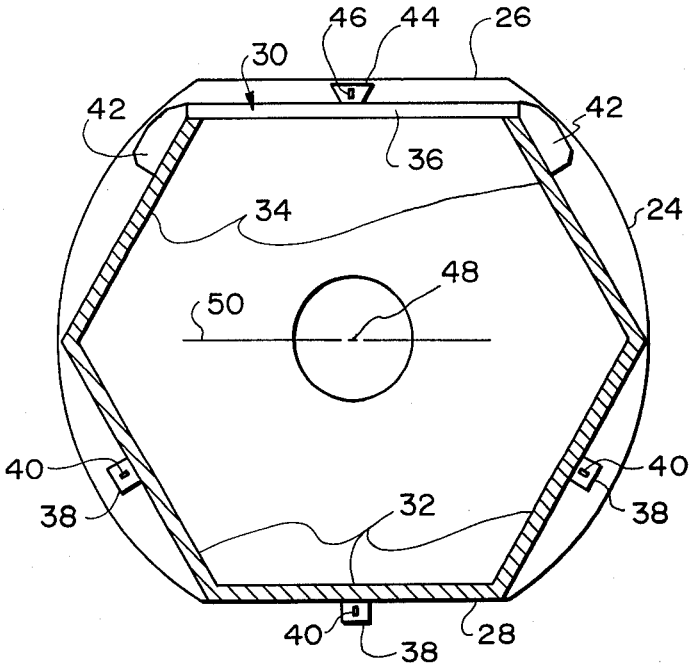
FIG. 3 is an enlarged sectional view of the plating barrel illustrated in FIG. 2.
Figure 4:
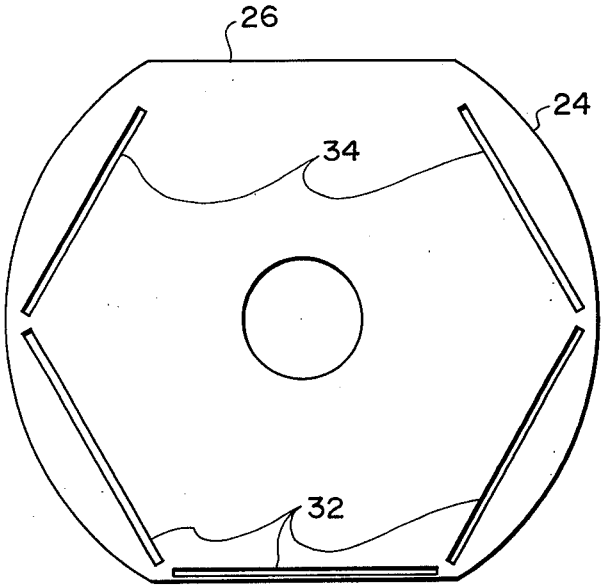
FIG. 4 is an elevational view of the inside surface of an end piece of an electroplating barrel such as illustrated in FIG. 3.

Unfortunately, this same simple structural modification cannot be used on the upper portion of the barrel as illustrated in FIG. 3 because of the sizes of the blocks 42 necessary to hold the door in place. The heavy door framing structure is necessary for reasons unrelated to the inventive concept disclosed herein.

Upon evaluating the dimensional relationships involved and working within the radial limitations allowable it was discovered that if the angles inside the barrels at the corners were maintained at 120°, then panels 34 of the same conventional size could be used and a door of exactly two increased conventional sizes would exactly fit into the resulting door opening. To explain it differently and by way of illustration, an end piece of conventional size for a 14 inch electroplating barrel will accommodate three side panels 32 which are for 16 inch conventional size barrels, side panels 34 which are of conventional size for 14 inch barrels and a door which is for a conventional 18 inch size barrel. The width of the two side panels 34 adjacent the side opening 30 is less than the width of at least half the remaining side panels 32 and in the preferred embodiment being of less width than all remaining side panels 32. Thus, by the manipulation of conventional elements used in conventional barrels the inventor herein has been able to provide a number of barrels mounted within a conventional sized circular periphery which is of increased internal barrel volume. It is an important contribution because the limitation on the number of parts which can be electroplated in an electroplating barrel is governed largely by the internal volume of the barrel. Increasing the internal volume increases the pounds of metallic articles which may be electroplated in one sequential plating operation but with no increase in time.

Figures 5, 6, 7:
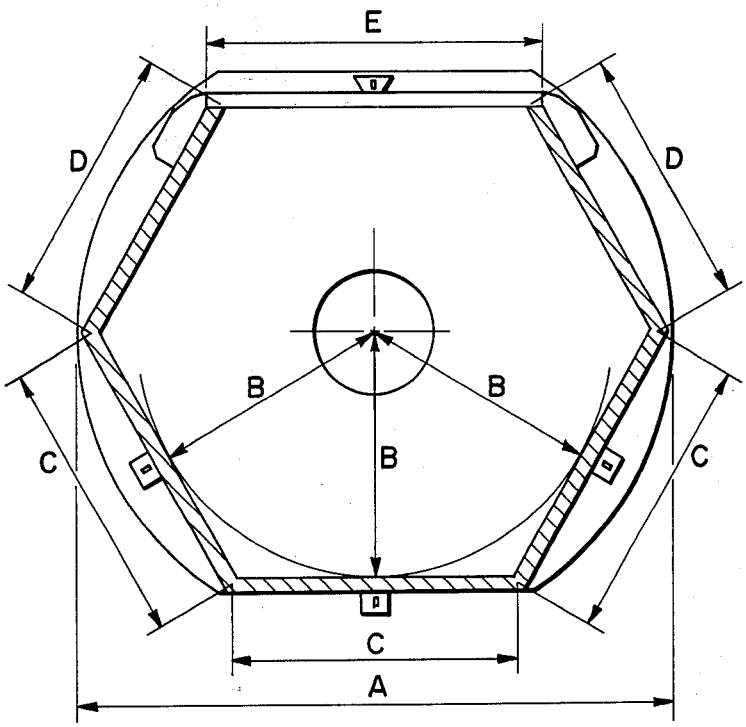
FIG. 5 is a sectional view of a plating barrel similar to FIG. 3 but including dimensional notations.
FIG. 6 is a chart showing the new dimensions for the barrel of FIG. 5.
FIG. 7 is a chart of the old dimensions of standard sized barrels generally as shown in FIG. 5.

FIG. 6 illustrates the new dimensions in contrast with the old dimensions for conventional barrels in FIG. 7.

The result of the invention is a nonsymmetrical hexagonal barrel for electroplating which is of longer life due to the placement of reinforcing bars and of increased volume within a given radius of rotation permitting replacement of conventional barrels with the new barrel but with no requirement of modification of the electroplating tank.

Lest it not be misunderstood, the anode 22 is an electrical connection which extends through the sides of the plating tank. One cannot simply move the anode 22 to accommodate different sizes of electroplating barrels. Once a tank is constructed it will accommodate a miximum size of electroplating barrel and traditionally a line of electroplating tanks is arranged to accommodate a specific size of electroplating barrel. Obviously, it is not economically practical to buy electroplating tanks to accommodate 22 inch size barrels where the barrels to be used are all 16 inch size barrels. Thus, once the tanks are installed and operational the electroplating shop is fixed as to the size of the barrel it can use practically in its tanks. Certainly smaller sized barrels could be used, but the tremendous amount of electrolyte in the larger size electroplating tanks could not be justified under those circumstances. What this invention does is allow an electroplating shop to increase the volume of its electroplating barrels by using the new barrels described herein but not requiring any modification whatsoever to its electroplating tanks.

Having thus described the invention in some detail, it will be obvious to those having ordinary skill in the art that certain modifications could be made without departing from the spirit of the invention. For example, the dimensions of the new barrel as set out in FIG. 6 could be modified slightly without departing from the real inventive concept. The width of the panels are set out to four decimal places and it is clear that this degree of accuracy cannot be realized in the cutting of plastic sheets a half inch or an inch thick and following plastic welding of the panels together. The theoretical measurements on panels cut on an angle are center line or average width measurements. Thus, where it is described in the specification and claimed in the appended claims with exact dimensions, it is not the intention that slightly modified dimensions would preclude infringement. It is not the intention of the inventor to be limited by the language of the specification but rather only by the language of the claims appended hereto.

I claim:

1. An electroplating barrel assembly of polypropylene adapted for use in electroplating in combination with electrodes bounded by two end pieces and five foraminous side panels joined along their edges to form a closed polygonal enclosure having one side opening, the side opening having a width greater than the width of any of the side panels and being adapted to receive a door to completely enclose anything within the barrel, the width of the two side panels adjacent the side opening being less than the width of at least half the remaining side panels.

2. The barrel of claim 1 including a reinforcing bar bonded to at least some of the panels.

3. The barrel of claim 2 wherein the reinforcing bars extend the full length of the barrels and said bars being oriented along lines approximately bisecting said panels.

4. The barrel of claim 3 wherein the width of the side opening being about 11.25 inches, the width of the two side panels adjacent the opening being about 8.372 inches, and the width of the remaining side panels being about 9.453 inches.

5. The barrel of claim 3 wherein the width of the side opening being about 12.375 inches, the width of the two side panels adjacent the opening being about 9.453 inches, and the width of the remaining side panels being about 10.608 inches.

6. The barrel of claim 3 wherein the width of the side opening being about 13.5 inches, the width of the two side panels adjacent the opening being about 10.608 inches, and the width of the remaining side panels being about 11.763 inches.

7. The barrel of claim 3 wherein the width of the side opening being about 14.625 inches, the width of the two side panels adjacent the opening being about 11.763 inches, and the width of the remaining side panels being about 12.918 inches.

8. The barrel of claim 3 wherein the width of the side opening being about 10.125 inches, the width of the two side panels adjacent the opening being about 7.144 inches, and the width of the remaining side panels being about 8.372 inches.

9. The barrel of claim 1 wherein the width of the side opening being about 11.25 inches, the width of the two side panels adjacent the opening being about 8.372 inches, and the width of the remaining side panels being about 9.453 inches.

10. The barrel of claim 1 wherein the width of the side opening being about 12.375 inches, the width of the two side panels adjacent the opening being about 9.453 inches, and the width of the remaining side panels being about 10.608 inches.

11. The barrel of claim 1 wherein the width of the side opening being about 13.5 inches, the width of the two side panels adjacent the opening being about 10.608 inches, and the width of the remaining side panels being about 11.763 inches.

12. The barrel of claim 1 wherein the width of the side opening being about 14.625 inches, the width of the two side panels adjacent the opening being about 11.763 inches, and the width of the remaining side panels being about 12.918 inches.

13. The barrel of claim 1 wherein the width of the side opening being about 10.125 inches, the width of the two side panels adjacent the opening being about 7.144 inches, and the width of the remaining side panels being about 8.372 inches.

* * * * *